United States Patent [19]

Faulkner

[11] 4,140,039

[45] Feb. 20, 1979

[54] HAND HELD SYNTHESIZER

[76] Inventor: Alfred H. Faulkner, 1324 Portesuello Ave., Santa Barbara, Calif. 93105

[21] Appl. No.: 675,835

[22] Filed: Apr. 12, 1976

[51] Int. Cl.[2] ..... G10H 1/00

[52] U.S. Cl. ..... 84/1.03; 84/DIG. 7; 84/DIG. 22

[58] Field of Search ..... 84/1.01, 1.03, 1.17, 84/1.24, DIG. 7, DIG. 22, DIG. 23; 340/365 E

[56] References Cited

U.S. PATENT DOCUMENTS

| | | | |
|---|---|---|---|
| 3,544,693 | 12/1970 | Tripp | 84/1.01 |
| 3,624,263 | 11/1971 | Uchiyama | 84/1.03 |
| 3,696,201 | 10/1972 | Arsem et al. | 84/1.01 |
| 3,697,661 | 10/1972 | Deutsch | 84/1.01 |
| 3,753,007 | 8/1973 | Viswanathan | 307/247 A |
| 3,771,130 | 11/1973 | Moses | 340/147 LP |
| 3,806,623 | 4/1974 | Tamada | 84/1.01 |
| 3,821,712 | 6/1974 | Wetzel | 340/172.5 |
| 3,828,108 | 8/1974 | Thompson | 84/1.01 |
| 3,844,192 | 10/1974 | Brand et al. | 84/1.01 |
| 3,855,894 | 12/1974 | Thomas et al. | 84/423 |
| 3,882,751 | 5/1975 | Tomisawa et al. | 84/1.01 |
| 3,886,543 | 5/1975 | Marin | 340/365 E |
| 3,902,393 | 9/1975 | Nagahama | 84/1.01 |
| 3,916,750 | 11/1975 | Uetrecht | 84/1.01 |
| 3,929,051 | 12/1975 | Moore | 84/1.17 |
| 3,930,429 | 1/1976 | Hill | 84/1.01 |
| 3,935,784 | 2/1976 | Koedice | 84/435 |
| 3,941,023 | 3/1976 | Thomas et al. | 84/1.01 |
| 3,951,028 | 4/1976 | Robinson | 84/1.01 |
| 3,954,039 | 5/1976 | Southard | 84/1.01 |
| 3,954,039 | 5/1976 | Southard | 84/1.01 |
| 3,990,339 | 11/1976 | Robinson et al. | 84/1.17 |
| 4,012,980 | 3/1977 | Suzuki | 84/1.01 |
| 4,019,417 | 4/1977 | Carlson | 84/1.01 |
| 4,030,398 | 6/1977 | Dittmar | 84/1.26 |
| 4,031,797 | 6/1977 | Schmoyer | 84/470 |

*Primary Examiner*—Robert K. Schaefer
*Assistant Examiner*—Vit W. Miska

[57] ABSTRACT

A sophisticated polyphonic instrument providing both additive and subtractive tone synthesis capabilities for generating a myriad of timbres, yet occupying a volume comparable to a toy accordion, is described. The unusually broad capabilities, for a small size synthesizer, is achieved through use of the novel LSI oriented circuits described in copending applications entitled "Electronic Organ With Multi-Pitch Note Generators", Ser. No. 610,733, filed Sept. 5, 1975, and "Automatic Arpeggio For Multiplexed Keyboard", Ser. No. 675,834, filed Apr. 12, 1976. The small size is made possible by use of LSI circuits in conjunction with a novel note keyboard arranged to select any note of the chromatic scale over a five octave range with only five keys, played by the right hand, and a novel chord keyboard, played by the left hand, arranged to select any one of ten chords based on the selected note as its root. The chord may be selected in its fundamental or either of two inverted forms. Since the position of the fingers relative to the chord keyboard cannot be easily seen, when the instrument is being held in the manner of an accordion, the chord buttons are grouped and shaped in a unique way that enables "playing blind" to be accomplished easily. To eliminate the need for modified fingering when transposing, provisions are described for changing keys rapidly using only the note keyboard.

6 Claims, 9 Drawing Figures

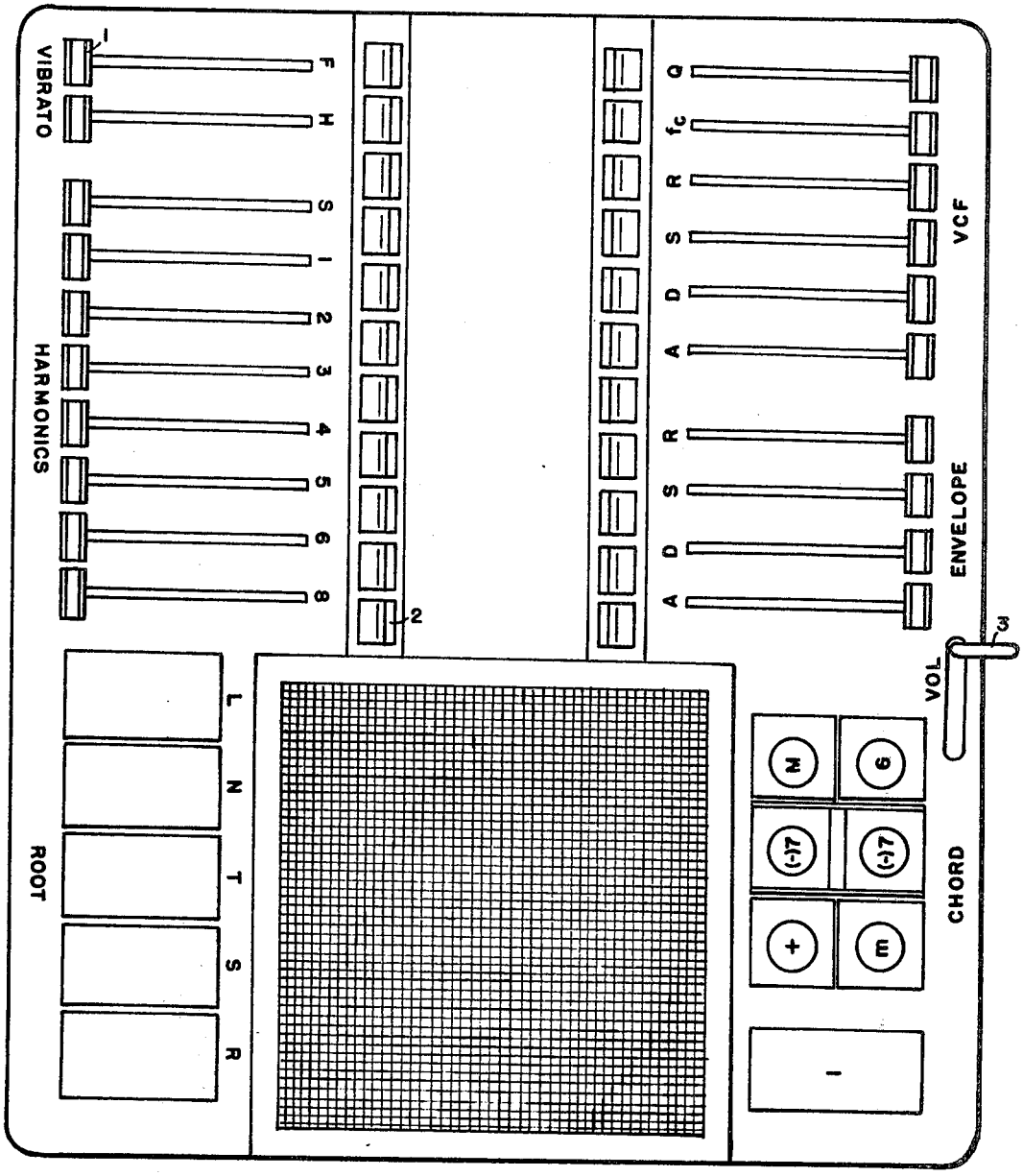
FIG. 1
FIG. 2
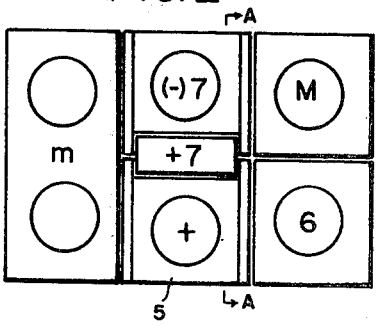
FIG. 3
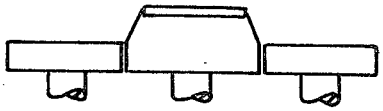
FIG. 4
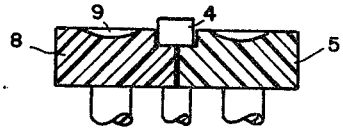
Sect. A-A

TS-a
Øa
Øl
Ø5
Ø6

CKB
CDR
CHR
CHL
CSR
NKB
NDR
NTR
DCR
NSR
KSR
ØSR
BSW
ARP
VCF
EGF
ARF
PSC
HRC
NGS
EGN
ARN
TOD
OSC
AMP
TMG
CDm
(N+T+S)
L-Ri
mi
TSa:PA

HAND HELD SYNTHESIZER

SUMMARY OF THE INVENTION

The principal feature of the invention is the novel arrangement providing for selection of any note of the chromatic scale with three keys operated in seven combinations to select notes corresponding to the major or minor scale and providing for selection of intermediate steps of the full chromatic scale with double touch switches on all three keys. Two additional keys, one on each side of the first three, provide for pitch changes in octave steps. Double touch operation of one of these switches provides a corresponding up or down pitch change of two octaves. Simultaneous operation of both octave selection keys causes the note corresponding to the state of the three note selection keys to be stored in a register as the keynote, or tonic, to effect automatic transposition to the selected key in subsequent playing. Simultaneously with the storing of the keynote, a flip-flop is set true or false to store the scale selection, major or minor, under control of the double touch switch on one of the octave select keys. During subsequent playing, this flip-flop modifies the note selection encoding logic to produce either a major or minor scale sequence. All of these selections can be performed simply and quickly by finger movements of one hand.

The synthesizer is arranged to play a melody using the note selection feature above; but, by use of a second feature of the invention, this note may be augmented at any time by additional notes forming a chord based on use of the selected note as the root. A unique physical arrangement of five chord buttons form a novel chord keyboard that enables "playing blind" to be accomplished easily. Individual operation of the five buttons selects a corresponding one of five chords with double touch operation of the 7th chord button selecting the diminished 7th chord. The minor 6th, augmented 7th and major 7th chords are each selected by a pair of buttons arranged for two finger operation. In alternative arrangements either the augmented 7th or minor 6th chord is selected by a pair of buttons arranged to be easily operated by one finger.

It is an object of the invention to provide a polyphonic synthesizer with broad capabilities that can be housed in a small enclosure to permit hand held operation.

Another object of the invention is to provide an electronic control system for a synthesizer with the above features to produce signals representing the selected notes in multiplexed form on a single bus to facilitate use of note generators implemented in LSI form.

Still another object of the invention is to provide a synthesizer wherein a major portion of the electronic circuits can be implemented with LSI chips developed primarily for use in electronic organs, whereby economical fabrication with a minimum of development expense is achieved.

BRIEF DESCRIPTION OF THE DRAWINGS

FIG. 1 is scale drawing of the synthesizer which shows a preferred arrangement of the various controls;

FIG. 2 is plan view of the chord keyboard per se;

FIG. 3 is a front elevation of the chord keyboard;

FIG. 4 is cross-sectional view of the chord keyboard taken at section A—A of FIG. 2;

DESCRIPTION OF A PREFERRED EMBODIMENT

Controls

Figure 5:
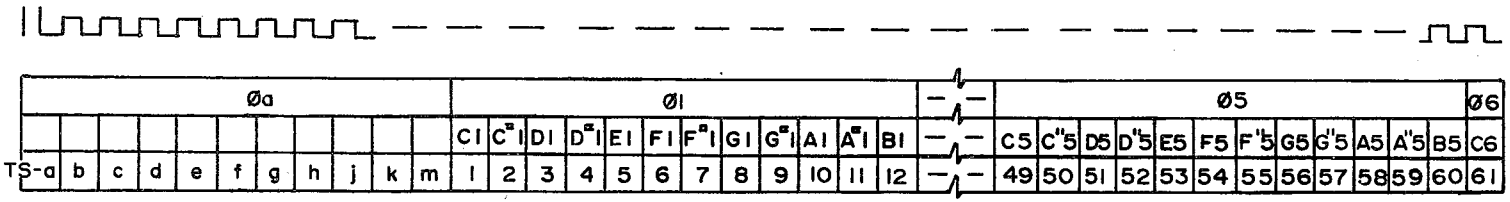
FIG. 5 is a timing chart showing the allocation of time slots in the proposed multiplex frame together with a combined clock and synchronizing pulse waveform.

FIG. 1 is actually an elevation view of the synthesizer when it is held in the intended playing position. While described as "hand held", it is intended that a shoulder strap or harness be used to support the instrument in the manner of a guitar or an accordion.

The two uppermost slide controls, such as 1 shown at the upper left corner of the drawing, control the vibrato speed and depth. The other eight slide controls on the left side are used to mix harmonically related sinusoidal signals in any proportions required to obtain desired timbres, or tone qualities, by additive synthesis.

The root, or note, keyboard is shown in the lower left portion of the drawing. The uppermost key, designated L, is used to lower the instrument's pitch by one or two octaves, depending on how far it is depressed. The central three keys N, T and S, select any note, or degree, of either the major or minor scale, depending on information stored during key registration, when partially depressed. Full depression of any operated one of these three keys raises, or lowers, the pitch a half-step. The choice of raising or lowering the pitch in response to double touch key operations is determined by the setting of a rocker switch 2. This choice allows all of the accidentals of like kind, i.e. either all of the accidental sharps or all of the accidental flats, to be obtained simply by using the double touch feature. The lowermost key, designated R, is used to raise the instrument's pitch by one or two octaves, depending on how far it is depressed.

The synthesizer's internal loudspeaker is located behind the grill in the lower central part of the drawing. When an external sound system is available the output of the synthesizer is preferably routed through it to take full advantage of the synthesizer's range.

The group of six slide controls shown at the upper right of the drawing are associated with a voltage controlled filter VCF used in conjunation with bright tone sources to obtain a variety of tone qualities by subtractive synthesis. The VCF may also be used with the sine wave mixtures to obtain special dynamic effects. Towards this end the Q control allows variation of the filter selectivity; the fc control allows the cutoff frequency of the low pass and high pass outputs, which is also the center frequency of the band pass output, to be varied; and the ADSR controls permit the waveform of the VCF voltage control input signal to be shaped as desired.

The right central group of four slide controls are associated with an envelope generator that controls the dynamic amplitude of both bright tones and sine wave tones produced by the synthesizer.

At the right side of the synthesizer, near the center, the volume control lever arm is shown. It is spring loaded in the vertical direction and is operated downward by pressing the left thumb against lever 3.

The chord keyboard is shown at the right lower corner of the synthesizer. The five closely spaced buttons are intended to be fingered by the first three fingers of the left hand. The little finger operates the detached button, designated I, that controls the chord inversions.

Aside from the inversions, there are ten musically useful three or four part chords each contained within an octave. These ten are commonly designated as shown in the following list:

1. Minor . . . m
2. Major . . . M
3. Augmented . . . +
4. Major 6th . . . 6
5. Dominant 7th . . . 7
6. Diminished 7th . . . −7
7. Minor 6th . . . m6
8. Minor 7th . . . m7
9. Augmented 7th . . . +7
10. Major 7th . . . M7

It will be observed that the last four chord designations are combinations of the first five designations, hence these chords might be easily selected by operating chord buttons bearing the first five designations in pairs; provided that they are physically located so as to allow this to be accomplished easily. It will also be observed that the designation −7 is unique, hence this chord can conveniently be selected by providing a double touch operation of the 7 chord button, rather than providing a unique button for the −7 chord. The − portion of the −7 chord designation is shown enclosed in parentheses (−) to indicate this dual function of the 7 chord button. The 7 designation also appears in combination with three others, m, + and M, hence its location in the chord keyboard must be considered in relation with these three in particular.

The physical arrangement and structure of one form of the chord keyboard is described in the following with reference to FIGS. 2, 3 and 4. The five buttons are arranged in three columns with one button, such as m, being located in one column and with a pair of buttons, such as pair +, 7 or pair M, 6 being located in each of the other two columns. It will be noted that, with the indicated assignment of locations, in each case where a pair of fingers are employed they may be located in the same row, thereby minimizing the finger dexterity required. The chord pair +, 7 occupies only one column, hence can be played with one finger. A dummy button 4, which overlaps recessed shoulders on buttons 5 and 8, may be provided to make one finger operation easier. The button 4 is elevated slightly above the adjacent buttons 5 and 8 to facilitate location of the fingers when "playing blind". The dimples, such as 9, in the top surface of the buttons provide additional help in finger location. A further aid to finger location is provided by elevating one column above the others, as shown in FIG. 3.

The assignment of chord buttons can be rearranged in a number of ways without changing the structure described above. For example, M and + can be interchanged without effect. M and 6 can be interchanged if the use of a pair of fingers not in the same row is not objectionable, which occurs in selecting M7 with this arrangement. The single finger column, assigned to +7 in the illustration, can be reassigned to m6 with (−)7 replacing m and + replacing 6 without detriment.

By allowing all four combination chrods to be selected with a pair of fingers, the dummy button can be dispensed with since single finger operation of two buttons can be avoided. For example, as shown in FIG. 1, the left column may have two buttons with the upper one assigned to + and the lower one assigned to m; the center column may be a single button, or two separate buttons, assigned to (−)7; and the right column may have its upper button assigned to M and its lower button assigned to 6. The columns and/or rows may be interchanged in any desired manner without detriment. Also the rows may be reversed without detriment. Reversal of a column is possible if selection by a pair of fingers not in the same row is not objectionable. An elevated, or depressed, section corresponding to 4 is desirable to aid in row location even when it is part of a one piece button. It may be provided, in addition or alternatively, at the adjoining edges of independent buttons located in the same column.

MULTIPLEX TIME FRAME

Before embarking on a description of the synthesizer circuit operation, the allocation of time slots in the multiplex time frame will be described to provide a basis for the signal designations employed in the schematic drawings.

Referring to FIG. 5, the entire frame of 72 intervals, each 40 μs long, is divided into six sectors $\phi 1$ to $\phi 5$ and ($\phi 6 + \phi a$), each having 12 time slots. The 11 slots, or bit times, of $\phi a$ are used solely for control purposes, hence are designated TSa through TSm. The 61 slots, or bit times, of $\phi 1$ to $\phi 6$ are designated TS1 through TS61 to correspond with the note, or key, numbers commonly used in the electronic organ industry. The corresponding note designations used by musicians are shown directly above the note numbers.

The square wave shown at the top of FIG. 5 is a tri-level clock designated CK in the schematic drawings. The three levels indicated are −5V, 0, and +5V. All other logic signals are at −5V when low, or false, and at +5V when high, or true. The full amplitude true signal in the first time slot, TSa, serves as a frame synchronizing pulse which allows separate timing generators to be used on different LSI chips with only one connecting lead being required to synchronize their operation.

Control System Operation

Figure 6:
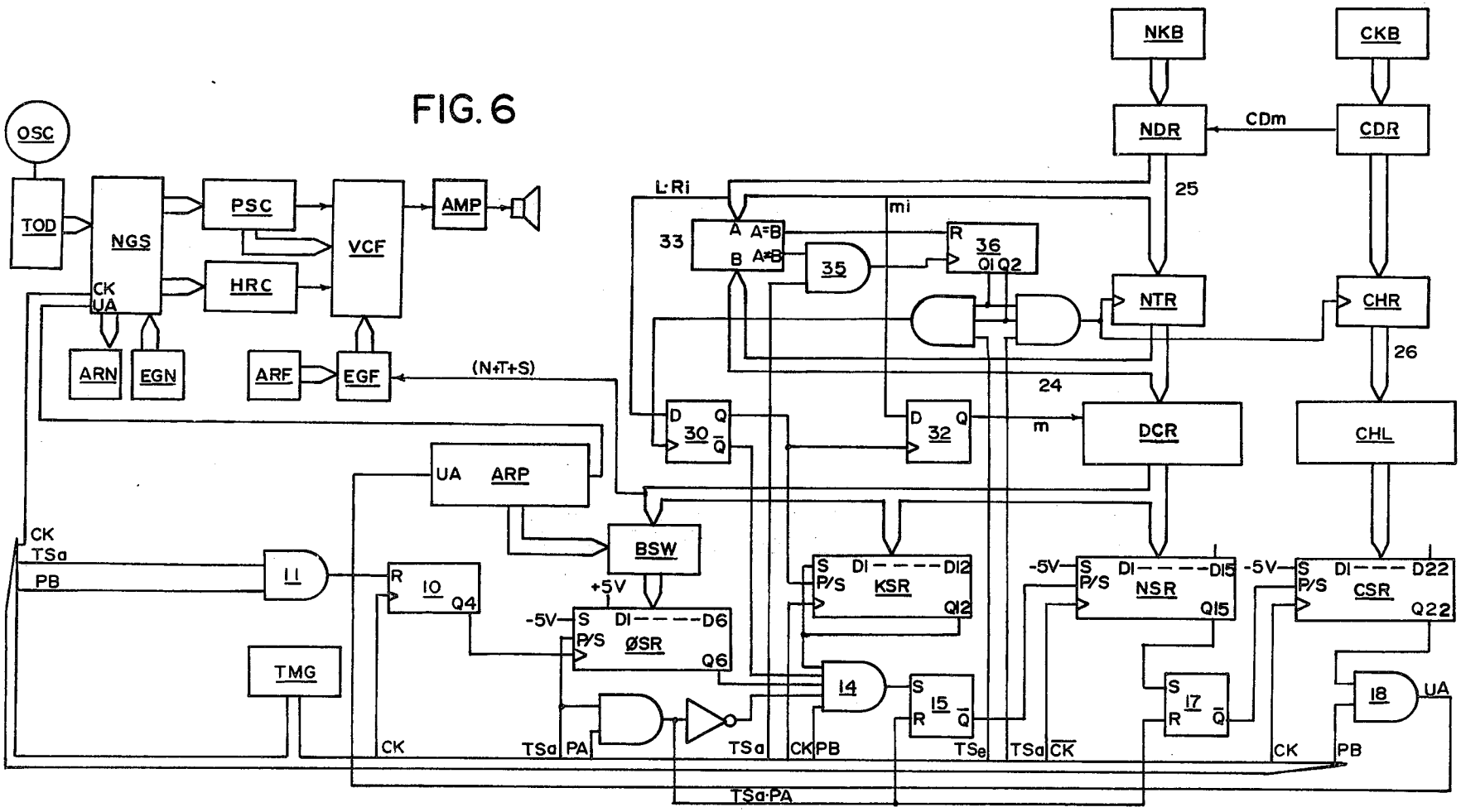
FIG. 6 is a block diagram of the synthesizer electronics.

Referring now to FIG. 6, the circuit operation will first be described with the assumption that the C major key has been previously selected, the L key (FIG. 1) is depressed to its second operated position to select the lowest octave $\phi 1$ and the N key (FIG. 1) is depressed to its first operated position to select the lowest note of the scale, and the automatic arpeggio is set to NORMAL. Under these circumstances, there is a "1", or high signal level, present at the following points:

1. The D12 input of chord register CSR
2. The D13 input of note register NSR,
3. The D4 input of keynote register KSR, and
4. The D6 input of octave register $\phi$SR.

These are all synchronous parallel or serial input/serial output static shift registers which function like the RCA type CD4014A but have a different number of stages.

The "1" at the D4 input of KSR is immaterial at this time since its P/S input is low, causing it to continuously recirculate a "1" bit that was loaded in when the keynote was selected previously. Since it is assumed that the key of C has been selected, the recirculating "1" bit appears at the output Q12 at TSa time and in all of the time slots assigned to note C♯. The purpose of the two bit lead is to compensate for two one-bit delays in subsequent circuit operations, as explained hereinafter.

The other three registers need not recirculate data, since they are reloaded at the start of every frame and are effective for only one cycle in each frame. They are, in effect, sequence timers that are operated in cascade to obtain a time delay equal of the sum of the delays represented by the data stored in each timer.

A hexbinary counter 10, shown in the lower left portion of the drawing, divides the clock CK by twelve continuously. At power turn-on gate 11 clears the counter to zero at TSa time to establish the desired phase relationship to the octave intervals $\phi 1$–$\phi 6$. The PB pulse is a 30 μs wide strobe which occurs every clock time and is centered in the 40 μs wide time slots. Each time that counter 10 reaches the count of 6 shift register $\phi$SR is advanced one count. The advance of $\phi$SR is thus synchronous with the octave intervals, but leads them by five bit times.

It was originally assumed that a "1" was present at the D6 input of $\phi$SR. At TSa time the P/S input of $\phi$SR is pulsed true loading the "1" bit into the sixth stage. It was also assumed that there was a "1" bit recirculating in KSR that appears at its Q12 output at TSa time. Since the Q6 ouput of $\phi$SR is also true at this time, flip-flop 15 is set true by gate 14 following the PA pulse. PA is a 5 μs wide pulse occurring in the 6th through 10th microseconds at each bit time. The P/S input to NSR is driven low, capturing the "1" bit at its D13 input to stage 13. This "1" is advanced to stage 15 in two bit times in synchronism with the rise of $\overline{CK}$. The "1" at Q15 of NSR sets flip-flop 17 which drives the P/S input to CSR low in the middle of TSb time. The "1" bit assumed to be present at the D12 input of CSR is now captured in stage 12 and is advanced to stage 22 with the rise of CK at the start of TS1 time. The "1" output at the Q22 output of CSR is strobed with PB by gate 18 and transmitted over the multiplex signal bus UA through the automatic arpeggio circuit ARP to the note generators NGS. Since no other "1"s were stored in CSR, no further pulses are produced on output UA during the remainder of the frame. This cycle of events is repeated every 2.88ms until the fingering of the note keyboard is changed. The manner in which this train of multiplex pulses is used to produce the desired C1 note by the note generators NGS is fully described in the copending application, cited earlier, pertaining to multipitch note generators.

If there had been a "1" at the D5 input of $\phi$SR, instead of at the D6 input, due either to operation of the barrel switch BSW by the automatic arpeggio ARP or to depression of key L to only its first operated position; then the Q6 output would be true from TSg time through TS7 time and the first coincidence with the recirculating "1" in KSR would occur at TS2 time; resulting in an output on UA at TS13 time; instead of TS1 time, which raises the pitch of the note generated by NGS by one octave. Similarly, placing the "1" in successively lower order stages of $\phi$SR increases the delay time 12 bits per stage and raises the pitch another octave. Hence placing a "1" in the second stage produces an output at TS49 time, corresponding to note C5. The top note C6 is reached by selecting the 8th scale degree with the note keyboard and by providing a permanent "1" at the D1 input of $\phi$SR.

In a similar fashion, placing the "1" in successively lower order stages of NSR increases the delay one bit per stage and raises the pitch one semi-tone. The criteria that determine the point at which the "1" is entered is described in the following section.

NOTE SELECTION

The sequence in which the note selection keys are operated through the seven possible combinations (000 is reserved to indicate the absence of any selection and to terminate any prior selection) is somewhat arbitrary since composers are free to choose notes in any sequence. However, sequences which follow the major or minor scale up or down over a range of several notes occur quite frequently, hence a gray code sequence for these scales facilitates playing such musical passages. Table I, shown below, is a truth table in which the columns headed N, T and S show the preferred gray code sequence from do at the bottom to ti at the top. The same code combination is repeated for notes mi and ti to indicate the pitch differences between the major and minor scales. The three columns at the right show the states of the note double touch NDT, sharp ♯, and minor m signals. The "X"s in these columns indicate 37 don't care" situations. Columns 2 and 3 list the inputs of KSR and NSR selected by the states shown on the same line in columns 4 through 9. The blanks in column 2 indicate disallowed states during key registration resulting from forcing the ♯ signal true and the m signal false during key selection. This simplifies key selection fingering for the player by allowing him to visualize a piano keyboard with the seven white keys corresponding to the seven combinations of N, T and S with do corresponding to C and with the black keys always viewed as sharps.

TABLE I

| Solmization | KSR | NSR | N | T | S | NDT | # | m |
|---|---|---|---|---|---|---|---|---|
| do | | D1 | | | | 1 | 1 | 0 |
| ti | D5 | D2 | 1 | 1 | 1 | 0 | X | 0 |
| | | D2 | | | | 1 | 1 | 1 |
| | | D3 | | | | 1 | 0 | 0 |
| (ti) | | D3 | 1 | 1 | 1 | 0 | X | 1 |
| | D6 | D3 | | | | 1 | 1 | X |
| la | D7 | D4 | 1 | 0 | 1 | 0 | X | X |
| | | D5 | | | | 1 | 0 | X |
| | D8 | D5 | | | | 1 | 1 | X |
| sol | D9 | D6 | 0 | 0 | 1 | 0 | X | X |
| | | D7 | | | | 1 | 0 | X |
| | D10 | D7 | | | | 1 | 1 | X |
| fa | D11 | D8 | 0 | 1 | 1 | 0 | X | X |
| | | D9 | | | | 1 | 0 | X |
| mi | D12 | D9 | 0 | 1 | 0 | 0 | X | 0 |
| | | D9 | | | | 1 | 1 | 1 |
| | | D10 | | | | 1 | 0 | 0 |
| (mi) | | D10 | 0 | 1 | 0 | 0 | X | 1 |
| | D1 | D10 | | | | 1 | 1 | X |
| re | D2 | D11 | 1 | 1 | 0 | 0 | X | X |
| | | D12 | | | | 1 | 0 | X |
| | D3 | D12 | | | | 1 | 1 | X |
| do | D4 | D13 | 1 | 0 | 0 | 0 | X | X |
| | | D14 | | | | 1 | 0 | X |

Figure 7:
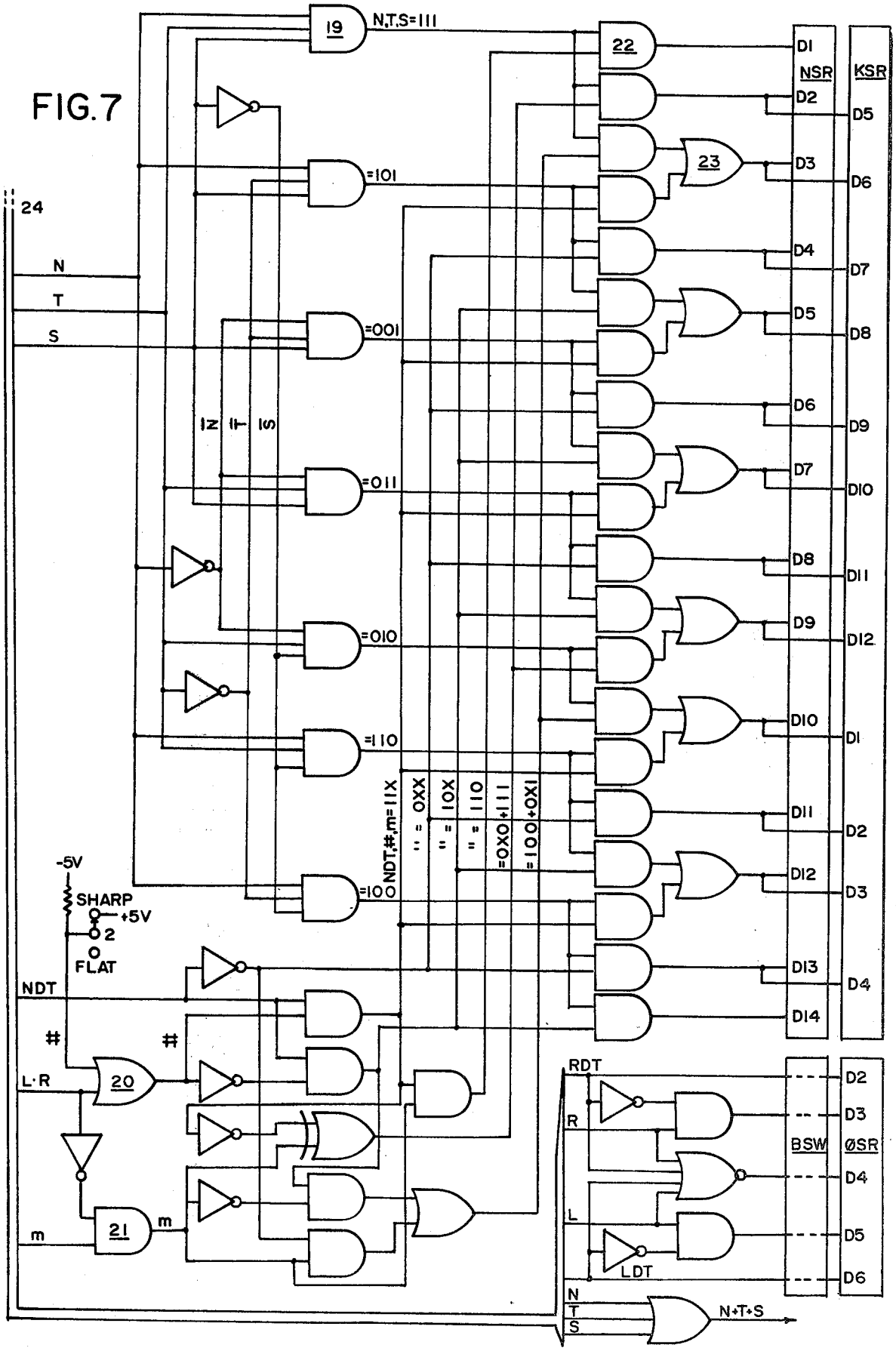
FIG. 7 is a schematic diagram of the decoder logic.

One of many possible logical implementations of this truth table is shown in the logic diagram of the decoder DCR shown in FIG. 7. The ♯ signal, which selects an increase in pitch in response to double touch operation of a note key, is derived from switch 2; which is intended to remain in the selected position throughout a composition. All other logic signal inputs are derived via signal group 24 from the note register NTR, hence are always coherent and cannot change at any time other than TSa. The N, T and S signals are decoded by seven gates, such as 19, to obtain the partial products, such as 111, corresponding to columns 4, 5 and 6 of Table I. The # signal from the output of OR gate 20 and the m signal from the output of AND gate 21 normally follow the corresponding input; but when keys L and R are depressed simultaneously the logic signal L·R becomes true, forcing the outputs of 20 and 21 to the true and false states, respectfully. These output logic signals, together with the NDT logic signal, are decoded to obtain the six partial products and sums of products which appear on the vertical busses in the center of the drawing. Counting from the left, the first three busses correspond with the partial products shown in lines 7, 8 and 9 of Table I and in four identical three line groups shown lower down in the table. The fourth buss corresponds uniquely with line 1 in the table. The fifth buss corresponds with the sum of products obtained by OR'ing lines 2 and 3, or lines 15 and 16, of the table. Similarly, the sixth buss corresponds with lines 4 and 5, or 17 and 18, of the table. These two sets of partial products are combined by AND gates, such as 22, and OR gates, such as 23, to obtain the 14 signals required for inputs D1 through D14 of NSR in accordance with Table I. 12 of these 14 signals are also extended to the D1 through D12 inputs of KSR as shown at the right of the drawing.

The signals for inputs D2 through D6 of $\phi$SR are derived by the logic shown in the lower right corner of FIG. 7. The manner in which these signals are shifted by the barrel switch BSW is fully described in the copending application cited earlier relating to an arpeggio control system. The N, T and S signals are also OR'ed by a gate 34 with the output going to the envelope generator EGF for the VCF. This signal (N+T+S) triggers EGF in response to selection of any note following an all zeroes state.

Figure 8:
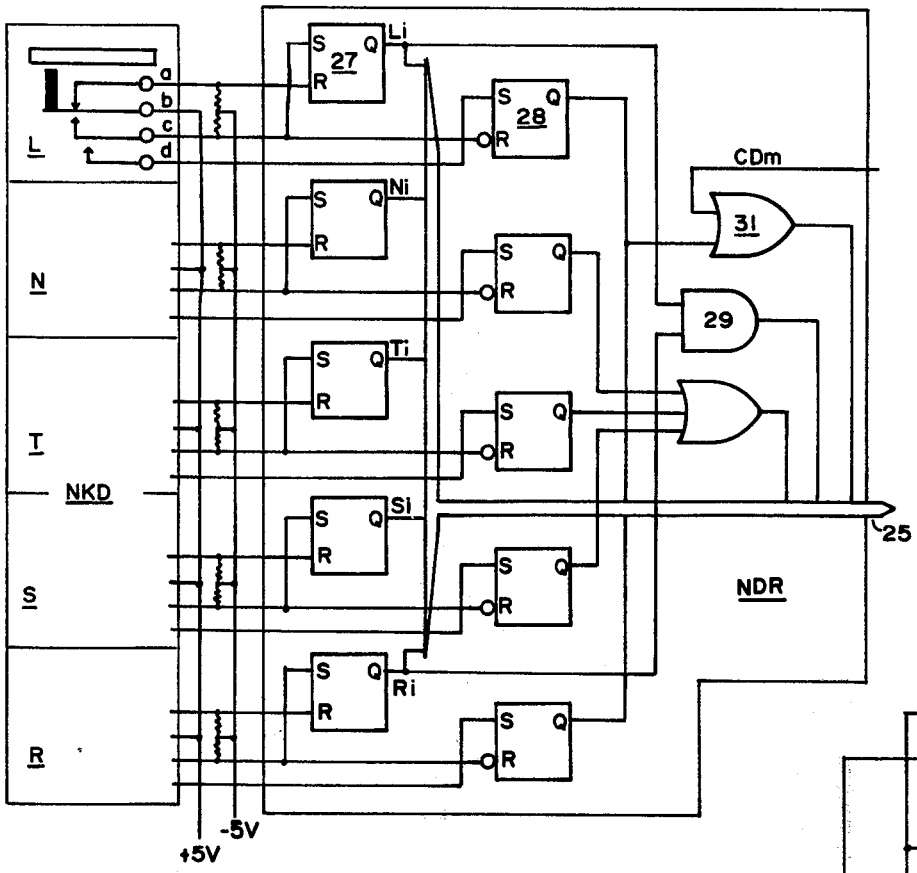
FIG. 8 is a schematic diagram of the note keyboard and associated debounce register.

Referring now to FIG. 8, the note keyboard NKD is shown on the left. Each of the five keys has a break-make-make spring combination like that shown for the L key. The break spring La is shown with a heavy line to indicate a rigid construction to provide a well defined point in the keystroke at which contact with the armature spring Lb is interrupted. The first make contact spring Lc is more flexible, but is tensioned upward against an insulated stop to provide an accurate point in the keystroke at which contact is made, and furthermore to provide a rapid increase in force required for further depression of the key; whereby the demarcation between the first and second operated states is accentuated. The second make contact spring Ld is not closed until the key is fully depressed.

To eliminate contact bounce from the logic signals, a flip-flop, such as 27, is provided for each key to introduce hysterisis into the signal generation in the conventional manner by setting 27 with make contact Lc and resetting it with break contact La. The double touch feature is similar in that a flip-flop 28 is set by the second make contact Ld and is reset when the first make contact, Lb and Lc, opens. The Li and Ri signals are AND'ed by gate 29 with the output L·Ri going to the D input of flip-flop 30 (FIG. 6) to control key registration as explained later. The LDTi signal is OR'ed with the CDm signal from the chord debounce register CDR (FIG. 6) by gate 31 with the output mi going to the D input of flip-flop 32 (FIG. 6) for scale registration, as described later. All of the signals included in group 25 extend to inputs of the note register NTR and all except mi also extend to the A group of inputs to comparator 33 (FIG. 6).

Referring now more specifically to FIG. 6, the outputs of NTR form the signal group 24 and include logic signals L, N, T, S, R, LDT, NDT, RDT, L·R, and m corresponding to the similarly designated inputs. All of these signals extend to inputs of the decoder DCR, described previously, and all except m extend to the B group of inputs to comparator 33.

Any change in state of signal group 25, except mi, causes the A $\neq$ B output of comparator 33 to become true, whereupon TSa is transmitted to the clock input of a binary counter 36 by gate 35. Following a delay of 8.6 to 11.5 ms the count of three is reached, whereupon register NTR and CHR are clocked by TSa to transmit the new state of the note decoder DCR and chord logic CHL. The B inputs of 33 now match the A inputs, hence the A = B output goes true and resets 36. The delay between detection and transmission is provided to avoid transmission of an ambiguous state during a change involving more than one key operation.

The chord keyboard CKB and debounce register CDR use the same type of circuits as those described for the note keyboard, but with only one flip-flop for each of the four single touch chord buttons. It will be noted that a change in state of the CDR outputs doe not effect a change in the NTR or CHR outputs until, or unless, accompanied by a note selection change. This allows new chords to be preselected and minimizes the coordination required between the player's hands.

KEY SELECTION

To register a key selection, the N, T and S keys are operated as described in connection with Table I to select the desired keynote and either the m chord button is operated or the L key is operated to its double touch position if it is desired to select the minor scale. Both the L and R keys must be operated to at least the single touch position. After the normal delay, flip-flop 30 is clocked true at TSe time, stopping the serial operation of KSR, enabling its parallel inputs, and clocking the state of signal mi into flip-flop 32. The desired key selection is clocked into NTR at TSa time setting the appropriate input of KSR to a "1".

Upon release of the keys, or at least the concurrent operation of L and R, flip-flop 30 is clocked false at TSe time, following the normal delay period, capturing the desired key selection in KSR and restoring its normal recirculating mode of operation. During key selection the Q output of flip-flop 30 is low, inhibiting gate 14 and thereby preventing any spurious output sounds.

CHORD SELECTION

Figure 9:
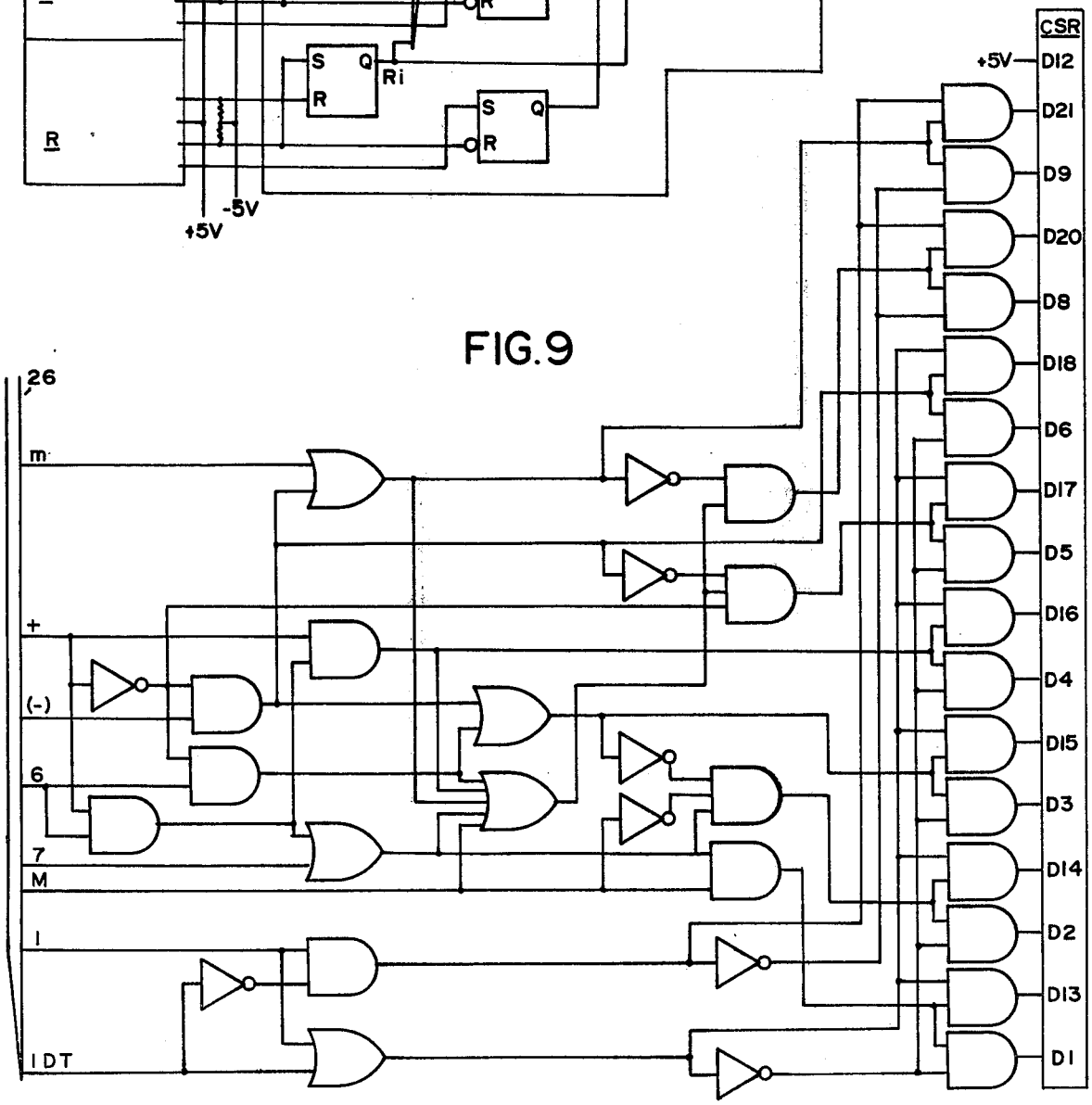
FIG. 9 is a schematic diagram of the chord logic.

As noted above, the chord keyboard and debounce register circuits are the same type as the note circuits, hence need not be shown or described in detail. The logic signal outputs of the chord register CHR are sent to the chord logic, shown in FIG. 9, as signal group 26. In the absence of a chord selection, a "1" is present only at the D12 input of CSR and the selected root note is sounded as a melody note as described previously. In the absence of a note selection, flip-flop 17 (FIG. 6) is never set, hence the presence of "1"s at the inputs to CSR has no effect.

The encoding of the chord select signals implemented by the logic diagram is best described by a truth table, as shown in Table II. The dual values in the column headings correspond to the fundamental and inverted forms of the chords. When the I chord button is depressed to its first operated position the D13–D21 inputs are made high instead of D1–D9 to lower all except the root tone one octave; and when depressed to its second operated position only the D13–D18 inputs are made high instead of D1–D6 to lower only the corresponding tones one octave.

TABLE II

| | CSR INPUTS | | | | | | | | | | |
|---|---|---|---|---|---|---|---|---|---|---|---|
| CHORD | D12 | | D9/21 | D8/20 | | D6/18 | D5/17 | D4/16 | D3/15 | D2/14 | D1/13 |
| m | 1 | | 1 | | | | 1 | | | | |
| M | 1 | | | 1 | | | 1 | | | | |
| + | 1 | | | 1 | | | | 1 | | | |
| 6 | 1 | | | 1 | | | 1 | | 1 | | |
| 7 | 1 | | | 1 | | | 1 | | | 1 | |
| −7 | 1 | | 1 | | | 1 | | | 1 | | |
| m6 | 1 | | 1 | | | | 1 | | 1 | | |
| m7 | 1 | | 1 | | | | 1 | | | 1 | |
| +7 | 1 | | | 1 | | | | 1 | | 1 | |
| M7 | 1 | | | 1 | | | 1 | | | | 1 |
| M deg. | 1 | 2 | | 3 | 4 | | 5 | | 6 | | 7 |
| m deg. | 1 | 2 | 3 | | 4 | | 5 | | 6 | 7 | |

IMPLEMENTATION

The circuits described do not place any severe requirements on the semiconductor technology used for its implementation; hence the choice may be made on the basis of cost and compatibility with external circuits they are to interface with. The timing generator employs approximately 160 transistors. The arpeggio control, including the barrel switch, employs approximately 1030 transistors. The remainder of the synthesizer control system employs approximately 2070 transistors. All three of these functions can easily be fabricated on a single chip with approximately 3200 transistors which is a moderate size by current LSI standards. The top octave dividers TOD require a single chip containing about 2300 transistors and the note generators NGS require three chips containing an average of about 3300 transistors each. Hence, the digital circuitry for the entire synthesizer can be implemented in five LSI chips. The remaining analog circuits can be implemented with integrated operational amplifiers and a few discrete component circuits.

Although the invention has been described and illustrated in detail, it is to be understood that the same is by way of illustration and example only, and is not to be taken by way of limitation. The spirit and scope of the invention is limited only by the terms of the appended claims.

I claim:

1. In a musical instrument, a keyboard having three note selection keys, a tone generator responsive to combinatorial operation of said keys to produce tone signals at corresponding degrees of a diatonic scale, a register connected between said keys and said tone generator, a timer responsive to initiation of a change in state of said keys to store the final state in said register after a predetermined delay, whereby undesired transient pitch changes corresponding to intermediate states which result from the finite time required to complete a combinatorial key selection manually are avoided, a chord selector providing additional inputs to said register to augment the keyboard note selection, a comparator having its inputs connected to certain corresponding inputs and outputs of said register so as to detect note selection changes but to be non-responsive to chord selection changes, said timer being controlled by said comparator to respond to a note selection change and to be unresponsive to a chord selection change, whereby a chord change can be preselected to become effective when accompanied by a note selection change.

2. In a musical instrument as claimed in claim 1, said keyboard having two octave selection keys providing additional inputs to said register to augment the note selection keys, said timer also being responsive to initiation of a change in state of said octave selection keys to store the final state of said keyboard.

3. In a musical instrument as claimed in claim 1, said chord selector comprising a 2×3 orthogonal array of five chord buttons for selecting desired chords by combinatorial operation of the buttons, one of said buttons being elongated to fill two spaces in said 2×3 orthogonal array to enable selection with a minimum of finger motion and to facilitate location of the player's fingers on the array by feel.

4. In a musical instrument having a set of chord selection buttons as claimed in claim 3, a double touch chord button included in said set, and an encoder responsive to operation of said button to the first touch position to produce selection signals for a dominate 7th (7) chord and responsive to operation of said button to the second touch position to produce selection signals for a diminished 7th (−7) chord.

5. In a musical instrument as claimed in claim 4, four additional chord buttons included in said set, said encoder being responsive to individual operation of the other four buttons to produce corresponding selection signals for major (M), minor (m), augmented (+), and major 6th (6) chords.

6. In a musical instrument as claimed in claim 5, said encoder being further responsive to operation of said five buttons in pairs to produce corresponding selection signals for minor 6th (m6), minor 7th (m7), augmented 7th (+7), and major 7th (M7) chords.

* * * * *